US007810287B2

(12) United States Patent
Lallemand

(10) Patent No.: US 7,810,287 B2
(45) Date of Patent: Oct. 12, 2010

(54) ARRANGEMENT OF ELEMENTS FOR PRODUCING A PANEL

(76) Inventor: Abel Lallemand, Hameau de Balmay, Vieu d'Izenave (FR) F-01430

( * ) Notice: Subject to any disclaimer, the term of this patent is extended or adjusted under 35 U.S.C. 154(b) by 333 days.

(21) Appl. No.: 11/883,061

(22) PCT Filed: Jan. 20, 2006

(86) PCT No.: PCT/FR2006/000130

§ 371 (c)(1),
(2), (4) Date: Jul. 26, 2007

(87) PCT Pub. No.: WO2006/079705

PCT Pub. Date: Aug. 3, 2006

(65) Prior Publication Data

US 2008/0110583 A1 May 15, 2008

(30) Foreign Application Priority Data

Jan. 26, 2005 (FR) ..... 05 00788

(51) Int. Cl.
*E04B 1/00* (2006.01)
*E04D 1/00* (2006.01)

(52) U.S. Cl. ..... 52/222; 52/656.1

(58) Field of Classification Search ..... 52/511, 52/63, 656.1, 656.7, 660, 222; 160/371, 160/373, 375, 378, 380, 381, 838, 374.1
See application file for complete search history.

(56) References Cited

U.S. PATENT DOCUMENTS

| | | | | |
|---|---|---|---|---|
| 3,529,653 | A * | 9/1970 | Fey, Jr. | 160/374.1 |
| 3,960,197 | A * | 6/1976 | Daniels | 160/371 |
| 5,275,224 | A * | 1/1994 | Morris | 160/327 |
| 6,132,666 | A | 10/2000 | Foley et al. | |
| 6,722,096 | B2 * | 4/2004 | Von Arx et al. | 52/511 |
| 2003/0136073 | A1 | 7/2003 | Von Arx et al. | |

FOREIGN PATENT DOCUMENTS

DE 203 19 808 U1 3/2004

* cited by examiner

*Primary Examiner*—Richard E Chilcot, Jr.
*Assistant Examiner*—Jessica Laux
(74) *Attorney, Agent, or Firm*—Young & Thompson

(57) ABSTRACT

An arrangement of elements includes a plurality of edging elements and a plurality of components consisting of a flexible material, the edging elements being assembled to form a structure on which a component consisting of a flexible material is placed. The edging elements include assembly members whose ends are respectively fixed in recesses, and the arrangement of elements includes connection elements provided with assembly members which are complementary to those of the edging elements. A connection element can be connected to two consecutive edging elements, once the edging elements have been assembled together with a flexible component, so as to ensure the positioning of the two edging elements without the direct and rigid assembly of the adjacent ends of two edging elements, such that the adjacent ends of two edging elements are simply held by the connection elements.

17 Claims, 4 Drawing Sheets

ARRANGEMENT OF ELEMENTS FOR PRODUCING A PANEL

FIELD OF THE INVENTION

The present invention relates to an arrangement of elements for producing a panel, this panel making it possible, with other identical panels, to cover a wall or build a wall, in particular to produce a false ceiling.

BACKGROUND OF THE INVENTION

To make a false ceiling, it is known to use square-shaped panels placed side by side, each panel comprising a structure made up by assembling a plurality of stiff edging elements and a piece of a flexible material stretched on this surface. The edging elements may in particular have a profiled shape, hollow inside, and the contiguous ends of two consecutive elements are assembled to each other through corner pieces engaged inside these elements.

The panels produced through some existing systems have the drawback of having structures likely to become distorted when the piece consisting of flexible materials are stretched on them, and/or of not allowing uniform tensioning of the piece consisting of a flexible material, meaning in all directions.

Moreover, the elements of some existing systems have the drawback of not being able to be simply and quickly assembled, without particular skills, which significantly limits their uses.

Furthermore, the existing systems do not allow quick and simple resolution of the issue of differences in level between the edges of panels adjacent to a panel to be put into place.

The existing systems also have the drawback of being relatively costly to produce.

Document U.S. Pat. No. 6,132,666 describes a system of mounting panels connected by corner pieces, this system not resolving the aforementioned drawbacks.

SUMMARY OF THE INVENTION

The present invention aims to resolve the drawbacks of the systems according to the prior art.

The arrangement of elements to which it relates comprises, in a known manner, a plurality of edging elements and a plurality of pieces consisting of a flexible material, the edging elements being able to be assembled to form a structure on which a piece consisting of a flexible material is placed.

According to the invention, the edging elements comprise assembly means, provided back from their ends, and the arrangement of elements comprises connection elements provided with assembly means which are complementary to those of the edging elements. A connection element can be connected to two consecutive edging elements, once the edging elements have been assembled together with a piece consisting of a flexible material, in such a way as to ensure the positioning of the two edging elements without the direct and rigid assembly of the adjacent ends of said two edging elements, such that the adjacent ends of the two edging elements are simply held be the connection elements.

Thus, in a panel made up using the arrangement of elements according to the invention, the adjacent ends of two edging elements are not assembled directly and rigidly to each other, but are simply held by the connection elements. This assembly results in an absence of any risk of warping of the structure made up by the edging elements and the connection elements when the piece consisting of a flexible material is placed on the structure. Moreover, the absence of connection of the adjacent ends of the two edging elements makes it possible to place the ends of two consecutive edging elements at slightly different levels if required by the placement of the edges of one panel next to the edges of two adjacent panels.

At least one connection element can be conformed so as to be tensioned in its assembly position, such that it exerts, on each edging element, a force intended to distance the adjacent ends of the two edging elements from each other.

Tensioning of the piece consisting of a flexible material may thereby be obtained.

Each edging elements preferably has oblique end surfaces, the end surfaces of two consecutive edging elements being positioned so as to come into the immediate vicinity of each other after assembly.

Preferably, each edging element is conformed to receive and hold an edge of the piece consisting of a flexible material at the level of its longitudinal side intended to be located outside said structure after assembly, each edging element being able to be rotated 180 degrees after assembly to the piece consisting of a flexible material, then to be assembled to the other edging elements.

The edging elements are thus, after assembly, covered by the piece consisting of a flexible material over one part of their outer edges, which not only gives the panels produced a good visual appearance, but is also favorable to obtaining uniform tensioning of the piece consisting of a flexible material.

Each edging element is preferably formed by the assembly of two bars able to receive an edge of the piece consisting of a flexible material between them and to be assembled together so as to hold this edge.

Advantageously, in this case, the bars comprise lugs and cavities sized such that that lugs of one bar can be frictionally engaged in the cavities of the other bar, and vice versa.

Assembly of the edging elements to the piece consisting of a flexible material can thus be done simply and quickly.

According to one preferred embodiment of the invention in this case, two bars intended to form an edging element are identical to each other and comprise alternating lugs and cavities developed along constant intervals, these lugs and cavities being disposed such that, when these two bars are positioned head-to-tail, the lugs of one bar are facing the cavities of the other, and vice versa.

The bars can thus be produced from a same mold, reducing the cost of manufacturing the arrangement of elements according to the invention.

The bars may also comprise, in this same case, pins protruding from their surfaces intended to squeeze the piece consisting of a flexible material, these pins being positioned such that, when the two bars are positioned head-to-tail, the pins of one bar are offset relative to the pins of the other bar.

These pins ensure perfect holding of the piece consisting of a flexible material between the bars.

According to one preferred embodiment of the invention, the connection elements are made up of rods or bars of a slightly elastically deformable material, in particular metal, the ends of which form or comprise said means for assembly to the edging elements.

At least some of the lugs of said bars may be hollow inside and the cavities for receiving these lugs may open onto the outside, the channels defined by these lugs thereby opening on the outside of the edging elements.

These channels make it possible to form means for assembling said connection elements to the edging elements, the means for assembling the connection elements then advantageously being formed by portions of these connection elements which may be tightly engaged in the channels formed by the lugs.

The edging elements may also comprise bosses and/or groove-lug assemblies constituting said means for assembling the connection elements to the edging elements.

BRIEF DESCRIPTION OF THE DRAWINGS

The invention will be well understood, and other characteristics and advantages thereof will appear, in reference to the annexed diagrammatic drawing, illustrating, as a non-exhaustive example, a preferred embodiment of various elements of the arrangement of elements it concerns.

FIG. 4 illustrates a square-shaped panel 1, enabling, with other identical panels, the creation of a false ceiling.

DETAILED DESCRIPTION OF EMBODIMENTS

Figure 1:
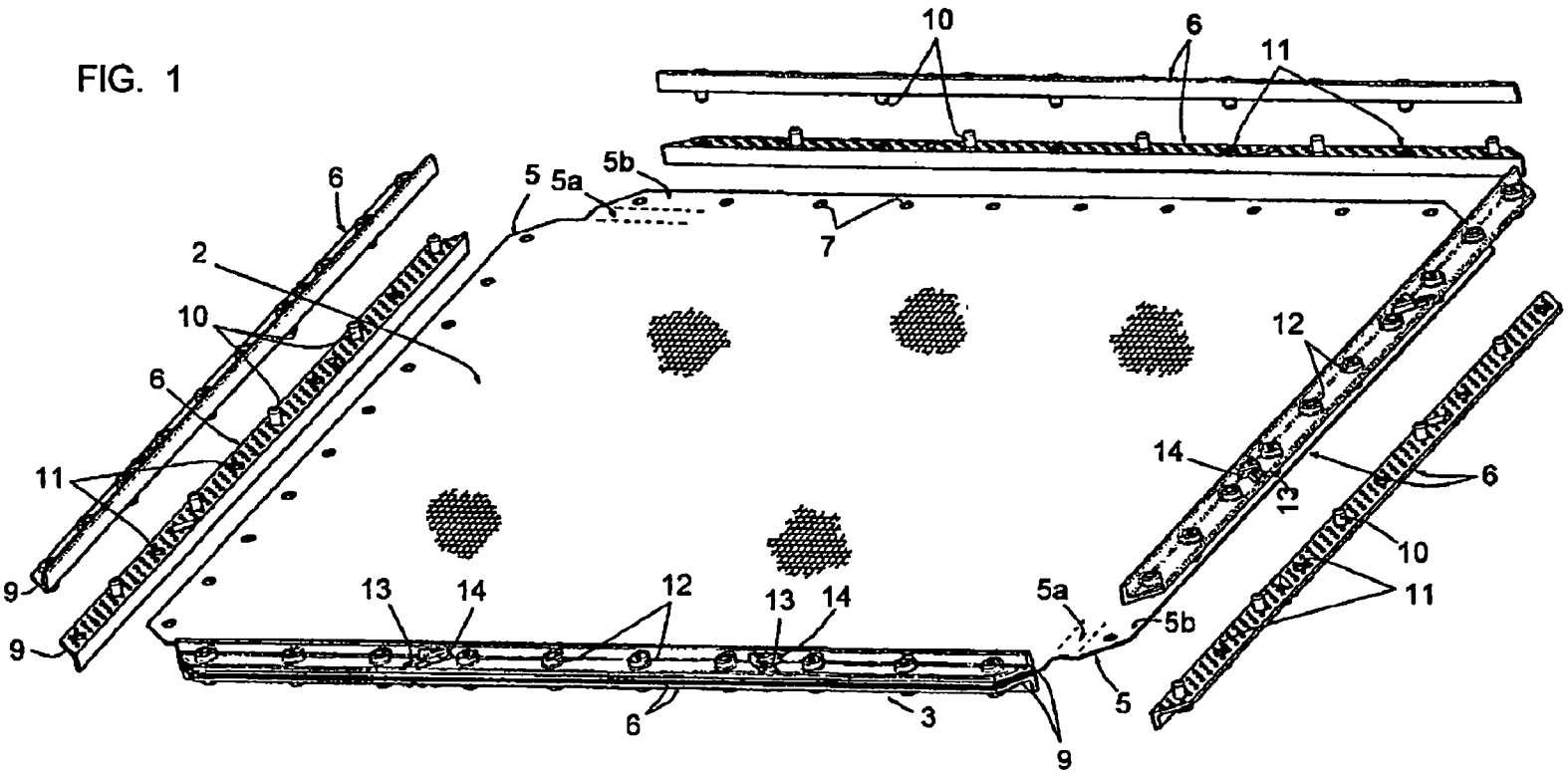
FIG. 1 is a perspective view of bars and a piece consisting of a flexible material comprised by this arrangement of elements.

The panel 1 comprises a piece consisting of a flexible material 2, edging elements 3 making it possible to construct a structure on which the component 2 is stretched, and connection elements 4 making it possible to connect the edging elements 3 to each other and hold them in place in relation to each other.

Figure 4:
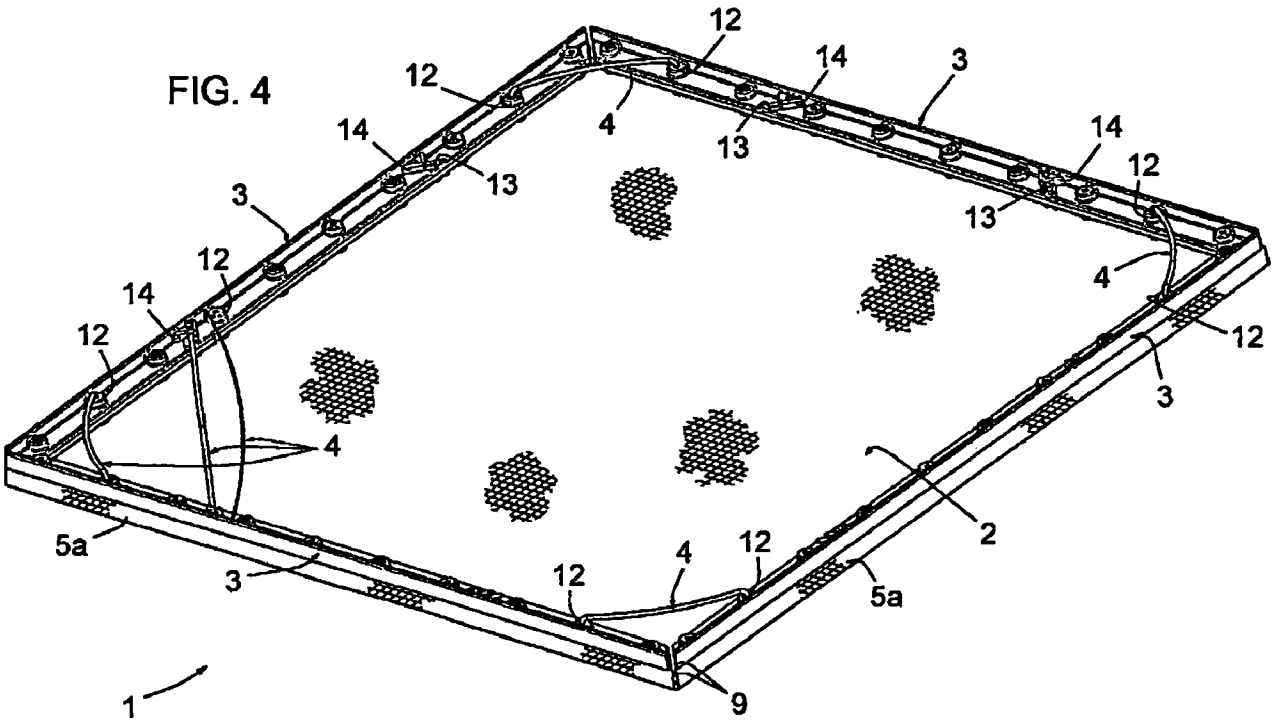
FIG. 4 is a perspective view of a panel obtained by means of bars, the piece consisting of a flexible material and connection elements comprised by said arrangement of elements.

The piece consisting of a flexible material 2 may be of any sort, in particular a network of thermoplastically-coated wires, disposed perpendicularly and welded to each other. As shown in FIGS. 1 and 4, the component 2 forms, beyond its part intended to cover one surface of the panel 1, tongues 5 extending each of the edges of this surface. Each tongue 5 comprises a part 5*a* adjacent to the edge of said surface, intended to partially cover the outer edge of an edging element 3, and a part 5*b* intended to be engaged between two bars 6 making it possible to form an edging element 3. This part 5*b* is pierced with regularly-spaced through holes 7.

Each bar 6 is formed by a molded synthetic component. It has, as shown more specifically by FIGS. 7 and 8, an L-shape, meaning that it defines a main wing intended to be positioned in the plane of the panel 1 after assembly, and a secondary wing whereof the outer surface extends in the direction of the height of the panel 1 after assembly.

Figure 6:
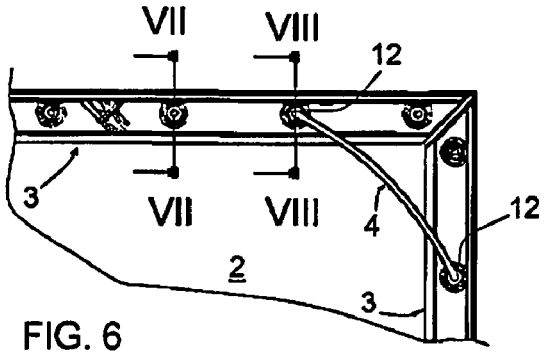
FIG. 6 is a partial top view of a panel.

Each bar 6 has an oblique end surface 9, oriented according to a 135-degree angle relative to the longitudinal axis of the bar 6, the end surfaces 9 of two consecutive bars 6 being developed so as to be in close proximity to each other after assembly, as shown in FIGS. 4 and 6.

Figure 2:
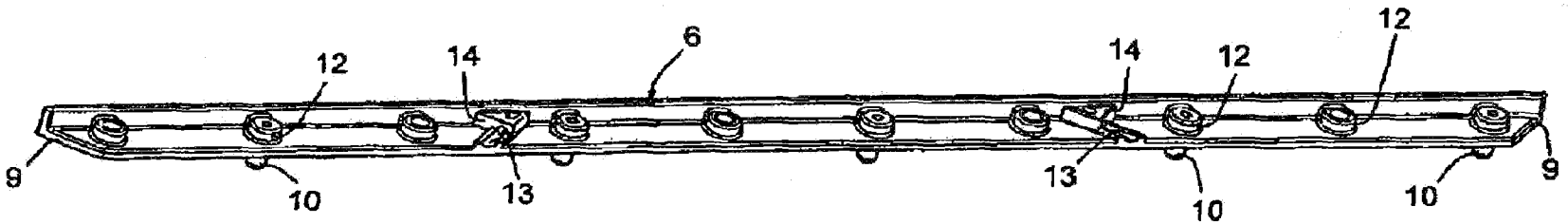
FIGS. 2 and 3 are perspective views of two bars able to be assembled together to form an edging element.
Figure 3:
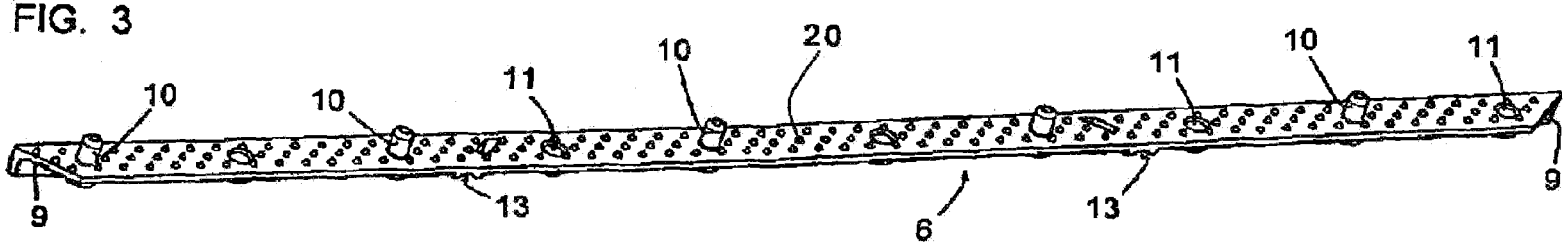

FIGS. 2 and 3 show that each bar 6 comprises lugs 10 and cavities 11 alternating and separated by a constant pitch, these lugs 10 and cavities 11 being disposed such that, when two identical bars 6 are disposed head-to-tail, the lugs 10 of one bar 6 are facing the cavities 11 of the other bar 6, and vice versa. These lugs 10 and cavities 11 are sized such that the lugs 10 of one bar 6 may be frictionally engaged in the cavities 11 of the other bar 6, and vice versa.

Each bar 6 also comprises cylindrical bosses 12 coaxial to the lugs 10 and cavities 11, located on the surface of said main wing opposite that on which the lugs 10 are found. The surface of the main wing on which the lugs 10 are found is covered with pins intended to be inserted in the material forming the piece consisting of a flexible material 2.

The lugs 10 are hollow inside and define channels, and the cavities 11 open onto the outside of each bar 6, such that these channels themselves open on the outside of the two bars 6 after assembly.

Each bar 6 also comprises an oblique groove 13 and a lug 14 defining a housing, this housing being intended to receive one of the ends of the connection element 4 illustrated in FIG. 11, as will be described below.

Moreover, each bar 6 comprises pins 20 protruding from its surface intended to squeeze the piece consisting of a flexible material 2, these said pins being positioned such that, when the two bars 6 are positioned head-to-tail, the pins of one bar 6 are offset relative to the pins of the other bar 6.

In practice, as may be inferred from FIG. 1, the holes 7 of one tongue 5 are engaged on the lugs 10 of a bar 6, then another bar 6 identical to the first is disposed head-to-tail relative to this first bar and is assembled to it through the mutual penetration of the lugs 10 and cavities 11.

Figure 7:
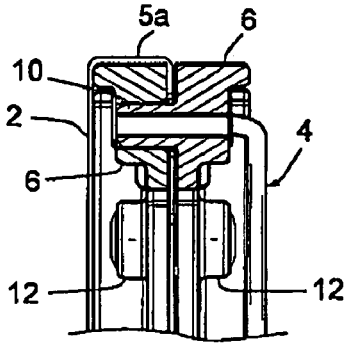
FIGS. 7 and 8 are enlarged views of this panel, in cross-sections according to lines VII-VII and VIII-VIII of FIG. 6, respectively.
Figure 8:
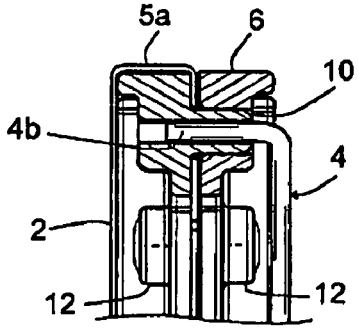

The edging element 3 thus formed is then rotated 180 degrees to bring said part 5*a* of the tongue 5 to stretch the length of the outer surface of said secondary branch of the second bar 6, as shown in FIGS. 4, 7 and 8.

As mentioned above, following rotation of two consecutive elements 3 for 180 degrees, the end surfaces 9 of these two elements are in immediate proximity to each other.

Figure 9:
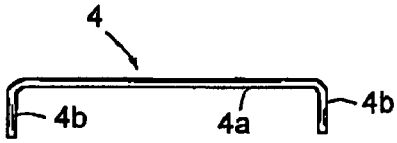
FIGS. 9 to 11 are views of different connection elements comprised by the arrangement of elements.
Figure 10:
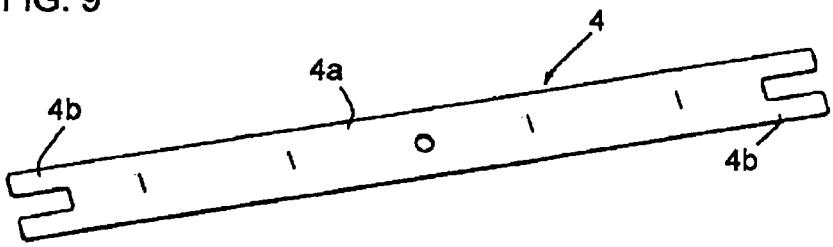
Figure 11:
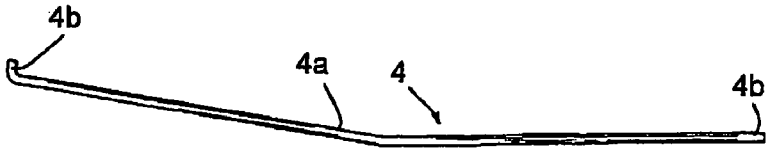

In reference to FIG. 4, on one hand, and FIGS. 9 to 11, on the other hand, it appears that the connection elements 4 enable the connection of two edging elements 3 in order to hold them in their assembly positions, resulting from the aforementioned rotation, in relation to each other.

Each connection element 4 has a main part 4*a* having a length slightly greater than the distance separating two bosses 12 located apart from the adjacent ends of the two elements 3, or two groove 13-lug 14 assemblies, and ends 4*b* modeled to cooperate with these bosses 12 or these groove 13-lug 14 assemblies.

The connection element 4 shown in FIG. 9 is formed by a metal rod curved at both ends to form the ends 4*b*, the diameter of this rod being such that these ends 4*b* may be frictionally engaged in said channels defined by the lugs 10.

The connection element 4 shown in FIG. 10 appears in the form of a metal bar, in the ends 4*b* of which notches have been developed to form forks. These forks enable engagement of these ends 4*b* on the main wings of the two bars 6 forming an edging element 3, bearing against the bosses 12, as shown in FIG. 4.

The connection element 4 shown in FIG. 11 has the form of a metallic rod bent at its central part, one end 4*b* of which is curved. This curved end 4*b* may be engaged in the groove 13, then in the housing formed by the lug 14 of one of the edging elements 3, then may be bent by manual pressure, thanks to its bent shape, so as to slightly shorten its length such that the other end 4*b* of this element 4 can be engaged in the housing defined by the lug 14 of the consecutive edging element 3.

Each connection element 4 can thereby be connected to two consecutive edging elements 3 by being tensioned in this assembly position, such that it exerts, on each edging element 3, a force tending to distance the ends of the two edging elements 3 from each other.

Figure 5:
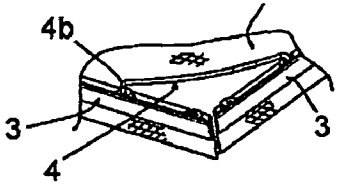
FIG. 5 is a partial perspective view of a corner of a panel in which two consecutive edging elements are not at the same level.

In the panel 1, the adjacent ends of two elements 3 are therefore not directly and rigidly assembled to each other, but are simply held, with tension, by the connection elements 4. The result is the absence of any risk of warping of the structure formed by the elements 3 when the component 2 is stretched, and a possibility of perfect tensioning of this component 2. Moreover, the absence of connection of the adjacent ends of the two elements 3 makes it possible to place the ends of two consecutive elements 3 at slightly different levels, as shown by FIG. 5, if placing the edges of the panel 1 next to the edges of two adjacent panels requires it. This difference in level is obtained by placing one of the ends 4*b* of the connection element 4 shown in FIG. 9 slightly less far into the corresponding channel of the lug 10.

As appears in the preceding, the invention provides an arrangement of elements having the determining advantages of making it possible to produce panels having structures not likely to warp when the components 2 are tensioned on them, allowing uniform tensioning of these components 2, being able to be assembled simply and quickly, without specific skills, simply and quickly resolving a problem of different levels between edges of panels adjacent to a panel having to be placed, and being relatively inexpensive to produce.

It goes without saying that the invention is not limited to the embodiment described above as an example, but that it extends to all embodiments covered by the annexed claims.

The invention claimed is:

1. An arrangement of elements for producing a panel, said arrangement comprising:

a plurality of edging elements, a flexible material, the edging elements being assembled to form a structure on which said flexible material is placed, the edging elements comprise edging assembly means spaced from ends of the edging elements, and connection elements provided with connection assembly means which are complementary to the edging assembly means of the edging elements, a respective one of said connection elements being connected to two consecutive said edging elements, once the edging elements have been assembled together with said flexible material, in such a way as to ensure the positioning of the two consecutive edging elements without direct and rigid assembly of adjacent ends of said two consecutive edging elements, such that the adjacent ends of the two consecutive edging elements are simply held by the respective one of the connection elements, wherein each of the edging elements is conformed to receive and hold an edge of the flexible material at a level of a longitudinal side of the flexible material intended to be located outside said structure after assembly, each edging element being able to be rotated 180 degrees after assembly to the flexible material, then to be assembled to other of said edging elements.

2. The arrangement of elements according to claim 1, wherein at least one of the connection elements is conformed so as to be tensioned in its assembly position, such that it exerts, on each corresponding edging element, a force intended to distance the adjacent ends of the two consecutive edging elements from each other.

3. The arrangement of elements according to claim 2, wherein each of the edging elements has oblique end surfaces, the end surfaces of two consecutive edging elements being positioned so as to come into the immediate vicinity of each other after assembly.

4. The arrangement of elements according to claim 2, wherein each edging element is formed by the assembly of two bars configured to receive an edge of the flexible material between said two bars and to be assembled together so as to hold said edge.

5. The arrangement of elements according to claim 2, wherein the connection elements are made up of rods or bars of a slightly elastically deformable material ends of said rods or bars form or comprise said connection assembly means for assembly to the edging elements.

6. The arrangement of elements according to claim 2, wherein the edging assembly means comprise bosses and/or groove-lug assemblies for assembling the connection elements to the edging elements.

7. The arrangement of elements according to claim 1, wherein each of the edging elements has oblique end surfaces, the end surfaces of two consecutive edging elements being positioned so as to come into the immediate vicinity of each other after assembly.

8. The arrangement of elements according to claim 1, wherein each of the edging elements is formed by assembly of two bars configured to receive an edge of the flexible material between them and to be assembled together so as to hold said edge.

9. The arrangement of elements according to claim 8, wherein the two bars comprise said edging assembly means, which include lugs and cavities sized such that that the lugs of one bar can be frictionally engaged in the cavities of the other bar, and vice versa.

10. The arrangement of elements according to claim 9, wherein the two bars are identical to each other and the edging assembly means comprise alternating lugs and cavities developed along constant intervals, said lugs and cavities being disposed such that, when said two bars (6) are positioned head-to-tail, the lugs of one bar are facing the cavities of the other bar, and vice versa.

11. The arrangement of elements according to claim 9, wherein said two bars are identical to each other and comprise pins protruding from their surfaces intended to squeeze the flexible material, said pins being positioned such that, when the two bars are positioned head-to-tail, the pins of one bar are offset relative to the pins of the other bar.

12. The arrangement of elements according to claim 8, wherein the two bars are identical to each other and comprise pins protruding from their surfaces intended to squeeze the flexible material, said pins being positioned such that, when the two bars are positioned head-to-tail, the pins of one bar are offset relative to the pins of the other bar.

13. The arrangement of elements according to claim 1, wherein the connection elements are made up of rods or bars of a slightly elastically deformable material, ends of said rods or bars form or comprise said connection assembly means for assembly to the edging elements.

14. The arrangement of elements according to claim 1, wherein the edging elements comprise bosses and/or groove-lug assemblies constituting said edging assembly means for assembling the connection elements to the edging elements.

15. An arrangement of elements for producing a panel, said arrangement comprising:

a plurality of edging elements, a flexible material, the edging elements being assembled to form a structure on which said flexible material is placed, the edging elements comprise edging assembly means spaced from ends of the edging elements, and connection elements provided with connection assembly means which are complementary to the edging assembly means of the edging elements, a respective one of said connection elements being connected to two consecutive said edging elements, once the edging elements have been assembled together with said flexible material, in such a way as to ensure the positioning of the two consecutive edging elements without direct and rigid assembly of adjacent ends of said two consecutive edging elements, such that the adjacent ends of the two consecutive edging elements are simply held by the respective one of the connection elements, wherein each of the edging elements is formed by assembly of two bars configured to receive an edge of the flexible material between them and to be assembled together so as to hold said edge, wherein the two bars comprise said edging assembly means, which include lugs and cavities sized such that that the lugs of one bar can be frictionally engaged in the cavities of the other bar, and vice versa, wherein the two bars are identical to each other and the edging assembly means comprise alternating lugs and cavities developed along constant intervals, said lugs and cavities being disposed such that, when said two bars (6) are positioned head-to-tail, the lugs of one bar are facing the cavities of the other bar, and vice versa, and wherein at least some of the lugs of said bars are hollow inside and the cavities for receiving said lugs open onto an outside of said edging elements, channels extending through said lugs thereby opening on the outside of the edging elements.

16. The arrangement of elements according to claim 15, wherein the connection assembly means for assembling the connection elements are formed by portions of said connection elements which may be tightly engaged in the channels formed through the lugs.

17. An arrangement of elements for producing a panel, said arrangement comprising:

a plurality of edging elements, a flexible material, the edging elements being assembled to form a structure on which said flexible material is placed, the edging elements comprise edging assembly means spaced from ends of the edging elements, and connection elements provided with connection assembly means which are complementary to the edging assembly means of the edging elements, a respective one of said connection elements being connected to two consecutive said edging elements, once the edging elements have been assembled together with said flexible material, in such a way as to ensure the positioning of the two consecutive edging elements without direct and rigid assembly of adjacent ends of said two consecutive edging elements, such that the adjacent ends of the two consecutive edging elements are simply held by the respective one of the connection elements, wherein each of the edging elements is formed by assembly of two bars configured to receive an edge of the flexible material between them and to be assembled together so as to hold said edge, wherein the two bars are identical to each other and comprise pins protruding from their surfaces intended to squeeze the flexible material, said pins being positioned such that, when the two bars are positioned head-to-tail, the pins of one bar are offset relative to the pins of the other bar, and wherein said two bars comprise said edging assembly means, which include lugs and complementary cavities, at least some of the lugs of said bars are hollow inside and the cavities for receiving said lugs open onto an outside of the edging elements, channels extending through said lugs thereby opening on the outside of the edging elements.

* * * * *